US008022606B2

(12) United States Patent
Suzuki et al.

(10) Patent No.: US 8,022,606 B2
(45) Date of Patent: Sep. 20, 2011

(54) ELECTRON MULTIPLER AND ELECTRON DETECTOR

(75) Inventors: Akio Suzuki, Hamamatsu (JP); Etsuo Iizuka, Hamamatsu (JP); Akihiro Kageyama, Hamamatsu (JP); Motohiro Suyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 16 days.

(21) Appl. No.: 12/715,570

(22) Filed: Mar. 2, 2010

(65) Prior Publication Data

US 2010/0225221 A1 Sep. 9, 2010

(30) Foreign Application Priority Data

Mar. 6, 2009 (JP) ..... P2009-053092

(51) Int. Cl.
*H01J 43/06* (2006.01)

(52) U.S. Cl. ..... 313/103 R; 313/528; 313/532

(58) Field of Classification Search ..... None
See application file for complete search history.

(56) References Cited

U.S. PATENT DOCUMENTS

| | | | | |
|---|---|---|---|---|
| 5,514,928 | A | 5/1996 | Niewold | |
| 5,770,858 | A | 6/1998 | Fuchs et al. | |
| 7,075,104 | B2 * | 7/2006 | Faris | 257/40 |
| 2008/0116367 | A1 * | 5/2008 | Kim et al. | 250/282 |

* cited by examiner

*Primary Examiner* — Ashok Patel
(74) *Attorney, Agent, or Firm* — Drinker Biddle & Reath LLP

(57) ABSTRACT

An electron multiplier that can easily obtain characteristics according to a purpose is provided. By bonding a marginal portion 23 of an MCP 2 and a marginal portion 33 of an MCP 3 to each other via a conductive spacer layer 7, a gap 12 is formed between channel portions 22, 32. Therefore, when the electron multiplier is used for a purpose that requires a particularly high gain, by adjusting the thickness of the spacer layer 7, the gain can be increased by increasing the gap 12. In addition, when the electron multiplier is used for a purpose that requires an increase in gain as well as time characteristics, by adjusting the thickness of the spacer layer 7, the size of the gap 12 can be adjusted so that desired characteristics are obtained. Consequently, by only adjusting the thickness of the spacer layer 7, characteristics according to the purpose can be easily obtained.

9 Claims, 19 Drawing Sheets

ELECTRON MULTIPLER AND ELECTRON DETECTOR

BACKGROUND OF THE INVENTION

1. Field of the Invention

The present invention relates to an electron multiplier including a micro-channel plate, and an electron detector including the electron multiplier.

2. Related Background Art

There has been known a conventional electron multiplier for which a plurality of micro-channel plates each formed by forming a large number of minute through-holes (channels) in a sheet-like glass substrate are laminated (refer to, for example, specification of U.S. Pat. No. 5,514,928). In this electron multiplier, a channel portion of each one of the micro-channel plates and a marginal portion surrounding the channel portion are bonded to a channel portion and a marginal portion of another micro-channel plate.

SUMMARY OF THE INVENTION

In the above-described electron multiplier, by making charged particles such as electrons or ions incident into the channels of a micro-channel plate applied with high voltage, and making the charged particles repeatedly collide with sidewalls in the channels so as to emit secondary electrons, incident electrons can be multiplied, and the multiplying effect is enhanced by making the electrons pass through the channels of a plurality of micro-channel plates. The multiplied electrons are detected by, for example, a detection section arranged at a position facing an emission surface of the micro-channel plate. The electron multiplier thus configured has various characteristics such as gain characteristics and time characteristics, and required characteristics vary depending on the purpose of the electron multiplier. Accordingly, it has been demanded to easily obtain characteristics according to the purpose.

The present invention has been made in order to solve the above-described problems, and it is an object to provide an electron multiplier that can easily obtain characteristics according to the purpose.

An electron multiplier according to the present invention includes: a plurality of laminated micro-channel plates; and an input-side electrode plate that is arranged on an electron incident surface side of the laminated micro-channel plates, in which the micro-channel plate includes a channel portion in which a plurality of channels penetrating in a thickness direction are formed and a marginal portion surrounding the channel portion, and has a gap formed between the channel portions of the respective micro-channel plates as a result of the marginal portions of the respective micro-channel plates being bonded to each other via a conductive spacer layer, and the input-side electrode plate is formed in an annular shape, and bonded to the marginal portion of the micro-channel plate.

In this electron multiplier, because the annular input-side electrode plate to be bonded to the marginal portion is provided on the electron incident surface side of the laminated micro-channel plates, it becomes easier to carry the electron multiplier as an electronic component where micro-channel plates and the electron plate are laminated and integrated, and incorporation into another electronic device can be made easier. Moreover, because the marginal portion of the micro-channel plate can be supported by the annular input-side electrode plate, deflection of the micro-channel plates can be corrected. Moreover, in this electron multiplier, because the gap is between the channel portions of the micro-channel plates, multiplied electrons that are emitted from one of the micro-channel plates spread wide in the gap to be made incident into the other micro-channel plate, thus this allows the multiplied electrons to enter many channels of the other micro-channel plate. Accordingly, the larger the gap, the more the gain can be increased. On the other hand, when the gap is large, multiplied electrons vary in traveling distance from each other because multiplied electrons spread wide in the gap, so that time characteristics are improved as the size of the gap is reduced. Accordingly, when the electron multiplier is used for a purpose that requires a particularly high gain, the gain can be increased by adjusting the thickness of the spacer layer to increase the gap, while the electron multiplier is used for a purpose that requires an increase in gain as well as time characteristics, desired characteristics can be obtained by adjusting the thickness of the spacer layer to adjust the size of the gap. As in the above, by only adjusting the thickness of the spacer layer, characteristics according to the purpose can be easily obtained.

Moreover, an electron detector according to the present invention includes the electron multiplier described above, wherein the electron multiplier multiplies electrons in order to detect the electrons. In this electron detector, by including the electron multiplier that can easily obtain characteristics according to the purpose, the performance as an electron detector can be easily improved.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Hereinafter, a preferred embodiment of an electron multiplier according to the present invention will be described with reference to the drawings.

Figure 1:
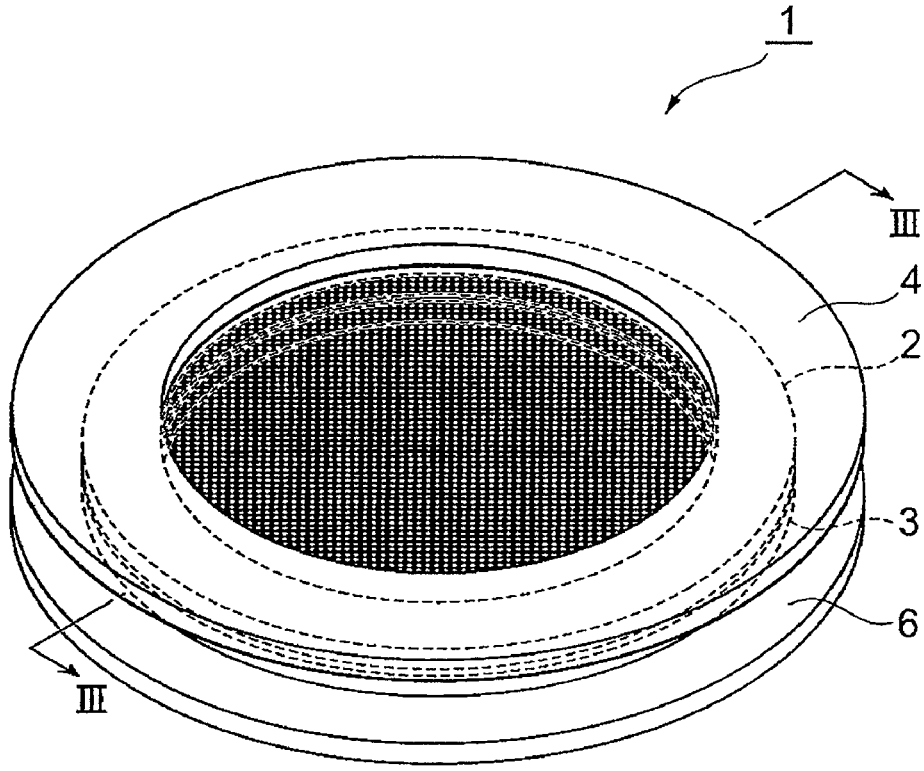
FIG. 1 is a perspective view of an electron multiplier according to an embodiment of the present invention.

FIG. 1 is a perspective view of an electron multiplier 1 according to an embodiment of the present invention. The electron multiplier 1 is formed by bonding a pair of disk-shaped micro-channel plates (hereinafter, referred to as "MCPs") 2, 3 to each other and further bonding while sandwiching the MCPs 2, 3 with an annular input-side electrode plate 4 and output-side electrode plate 6. This electron multiplier 1 is capable of converting incident charged particles such as electrons or ions to electrons on the surface of the MCP 2, and causing secondary electron multiplication inside the MCPs 2, 3, by applying high voltage to the MCPs 2, 3 via the input-side electrode plate 4 and the output-side electrode plate 6. The electron multiplier 1 can cover detection targets of ultraviolet rays, vacuum ultraviolet rays, neutron rays, and soft X-rays to hard X-rays, including electrons and ions, and can be applied to various electronic devices such as image intensifiers (I.Is) and mass spectroscopes.

Figure 2:
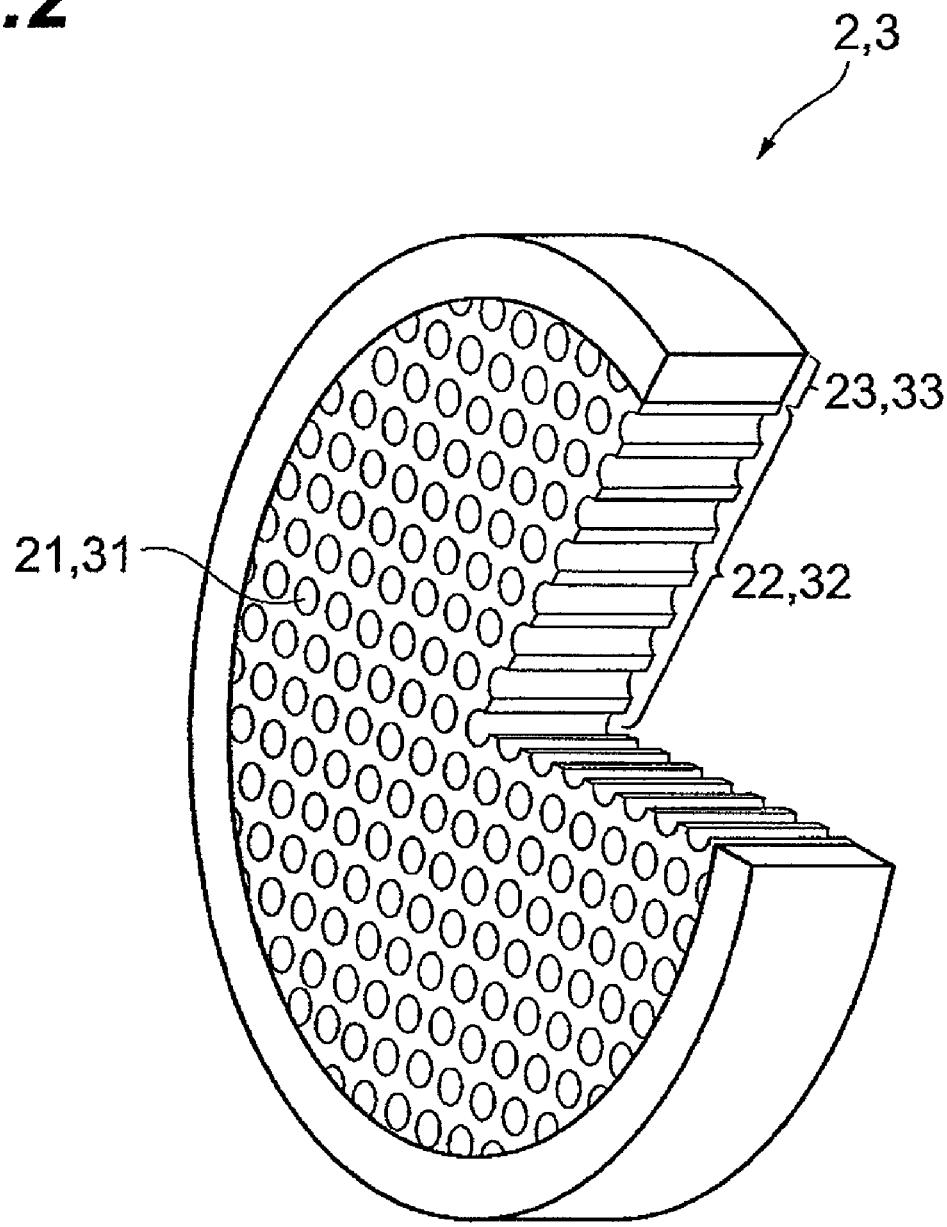
FIG. 2 is a perspective view of an MCP, which is shown partially cut away.

FIG. 2 is a perspective view of the MCP 2, 3, which is shown partially cut away. As shown in FIG. 2, the MCP 2 is formed with a channel portion 22 in which a plurality of through-holes (channels) 21 penetrating in a thickness direction are formed and a marginal portion 23 surrounding the outer periphery of the channel portion 22. The channel portion 22 of the MCP 2 is constructed by forming, for a disk-shaped glass substrate with a thickness of 100 μm to 2000 μm and a diameter of 10 mm to 120 mm, a large number of channels 21 each with an inner diameter of 2 μm to 25 μm in a circular region inside further than the marginal portion 23 having a width of approximately 3 mm from an outer peripheral portion. The MCP 2 is formed of glass or the like.

In the MCP 2 thus configured, when a high voltage of approximately 1 kV is applied between the electrodes, that is, both ends of the channels 21, an electric field orthogonal to an axial direction is generated in the channel 21. At this time, when electrons are made incident into the channel 21 from one end side, the incident electrons are imparted with energy from the electric field, and collide with an inner wall of the channel 21 to emit secondary electrons. As a result of such collision being repeated a large number of times, electron multiplication is performed by the electrons being exponentially increased. Accordingly, the channel portion 22 where the channels 21 are formed functions as an effective portion capable of multiplying electrons, while the marginal portion 23 where no channels 21 are formed does not function as an effective portion but functions as a support portion that supports the channel portion 22. The surface of the channel portion 22 and the marginal portion 23 is vapor-deposited with metal, and the vapor-deposited metal functions as an electrode of the MCP 2. Therefore, as a result of a voltage being applied to the marginal portion 23, a voltage is applied also to the channel portion 22. In addition, the MCP 3 has the same configuration as that of the MCP 2, and includes channels 31, a channel portion 32, and a marginal portion 33.

Figure 3:
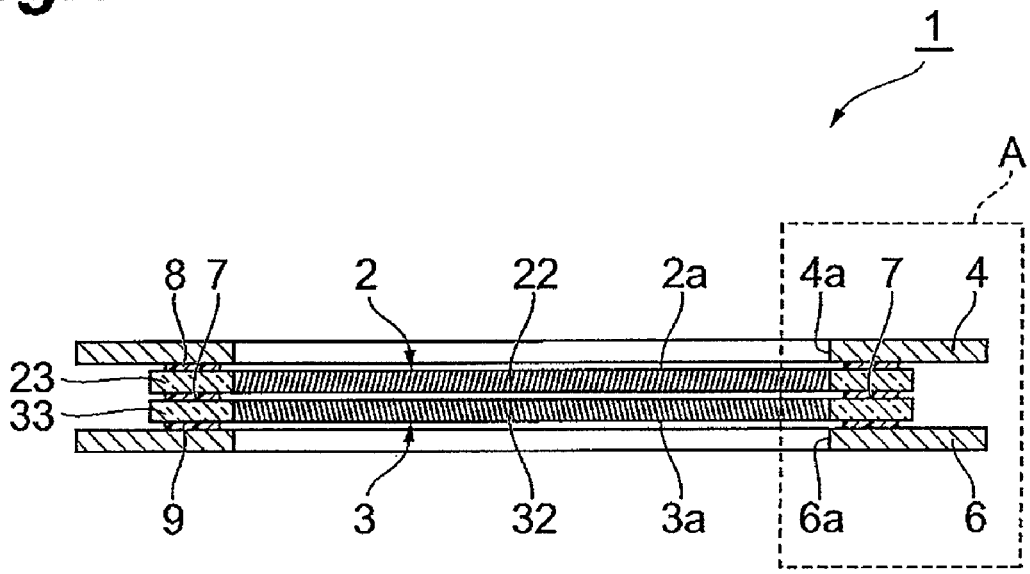
FIG. 3 is a sectional view along a line shown in FIG. 1.

FIG. 3 is a sectional view along a line III-III shown in FIG. 1. As shown in FIG. 3, the MCP 2 and MCP 3 are laminated so as to lie on top of each other when viewed in the thickness direction, and bonded to each other via a spacer layer 7 made of a conductive adhesive. The channel portion 22 of the MCP 2 and the channel portion 32 of the MCP 3 face each other in the laminating direction. Moreover, the spacer layer 7 is provided not on the channel portions 22, 32 of the MCPs 2, 3, but provided only on the marginal portions 23, 33. The spacer layer 7 is provided at four points around a central axis of the MCPs 2, 3 (details will be described later). Of both surfaces of the MCP 2, a non-bonding-side surface not facing the MCP 3 serves as an electron incident surface 2*a* into which electrons are made incident, and of both surfaces of the MCP 3, a surface on a non-bonding side not facing the MCP 2 serves as an electron emission surface 3*a* from which multiplied electrons are emitted.

The input-side electrode plate 4 has an annular shape, and arranged on the electron incident surface 2*a* side of the MCP 2. The input-side electrode plate 4 has an outer diameter of 10 mm to 125 mm, an inner diameter of 5 mm to 115 mm, a thickness of 0.3 mm to 2.0 mm. Moreover, the input-side electrode plate 4 is preferably made of a metal material containing a kovar metal that is close in thermal expansion coefficient to the MCPs 2, 3. This allows supporting the MCPs 2, 3 to correct deflection. The incident-side electrode plate 4 is bonded to a surface on the electron incident surface 2*a* side of the marginal portion 23 of the MCP 2 via a conductive adhesive 8 so that its central axis is coincident with that of the MCPs 2, 3. Therefore, the electron incident surface 2*a* of the channel portion 22 of the MCP 2 is exposed from an opening portion 4*a* in a central position of the input-side electrode plate 4. The output-side electrode plate 6 is made of the same material in the same shape as those of the input-side electrode plate 4, and arranged on the electron emission surface 3*a* side of the MCP 3. The output-side electrode plate 6 is bonded to a surface on the electron emission surface 3*a* side of the marginal portion 33 of the MCP 3 via a conductive adhesive 9 so that its central axis is coincident with that of the MCPs 2, 3. Therefore, the electron emission surface 3*a* of the channel portion 32 of the MCP 3 is exposed from an opening portion 6*a* in a central position of the output-side electrode plate 6. By applying a high voltage to the input-side electrode plate 4 and the output-side electrode plate 6, a high voltage is applied between the electron incident surface 2*a* of the MCP 2 and the electron emission surface 3*a* of the MCP 3 via the marginal portions 23, 33. In addition, the thickness of the input-side electrode plate 4 and the output-side electrode plate 6 is preferably controlled so as to be thicker than that of the MCPs 2, 3. This makes it possible to correct deflection of the MCPs 2, 3.

Figure 4:
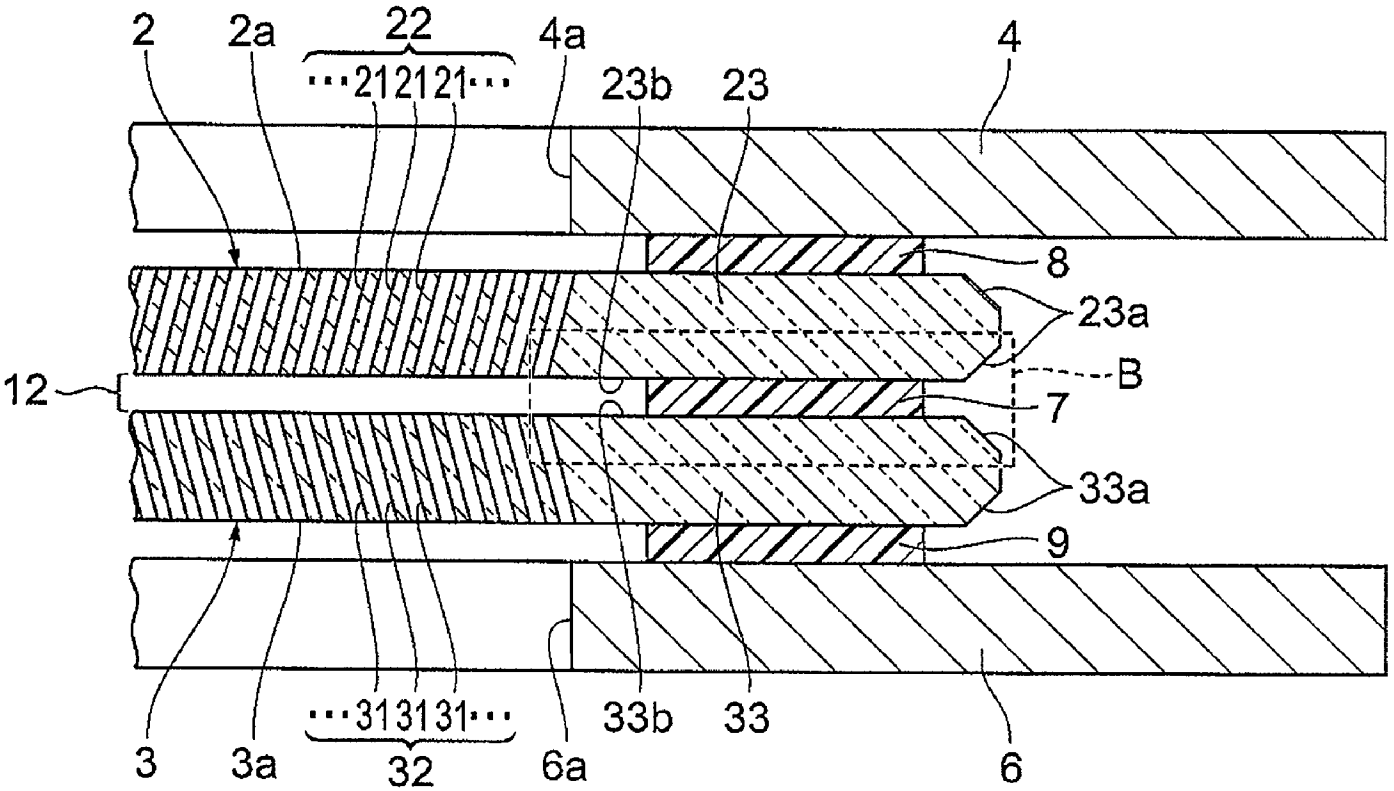
FIG. 4 is an enlarged view of a part surrounded by A in FIG. 3.

FIG. 4 is an enlarged view of a part surrounded by A in FIG. 3. As shown in FIG. 4, the channels 21 of the channel portion 22 of the MCP 2 penetrate while tilting at a predetermined angle (bias angle) with respect to the thickness direction, that is, the central axis of the MCP 2. For example, the bias angle of the channels 21 is set to 0° to 30°. Moreover, the channels 31 of the channel portion 32 of the MCP 3 tilt to the side opposite to the tilting direction of the channels 21 of the MCP 2, and penetrate while tilting at a predetermined angle (bias angle) with respect to the thickness direction, that is, the central axis of the MCP 3. For example, the bias angle of the channels 31 is set to 0° to 30°. This makes it easy that electrons made incident from the electron incident surface 2*a* side collide with the inner walls of the channels 21 of the MCP 2 and makes it easy that multiplied electrons made incident from the MCP 2 side collide with the inner walls of the channels 31 of the MCP 3, so that the multiplication efficiency of electrons is improved.

The spacer layer 7 is provided between the marginal portion 23 of the MCP 2 and the marginal portion 33 of the MCP 3. The spacer layer 7 forms a gap 12 between the channel portion 22 of the MCP 2 and the channel portion 32 of the MCP 3. This gap 12 has a size of 1 μm to 127 μm in the case of only an adhesive, and 100 μm to 1000 μm when a ring member is used, and the size can be appropriately selected, depending on characteristics required in the electron multiplier 1, by adjusting the thickness of the spacer layer 7 in manufacturing. Moreover, a bonding surface 23*b* and a bonding surface 33*b* on which the spacer layer 7 is arranged in the marginal portion 23 of the MCP 2 and the marginal portion 33 of the MCP 3 are separated from each other via the spacer layer 7. A chamfered portion 23*a*, 33*a* of approximately 0.1 mm is formed at a peripheral corner portion of the marginal portion 23, 33 of the MCP 2, 3. However, a corner R may be formed in place of the chamfered portion 23*a*, 33*a*.

Figure 5:
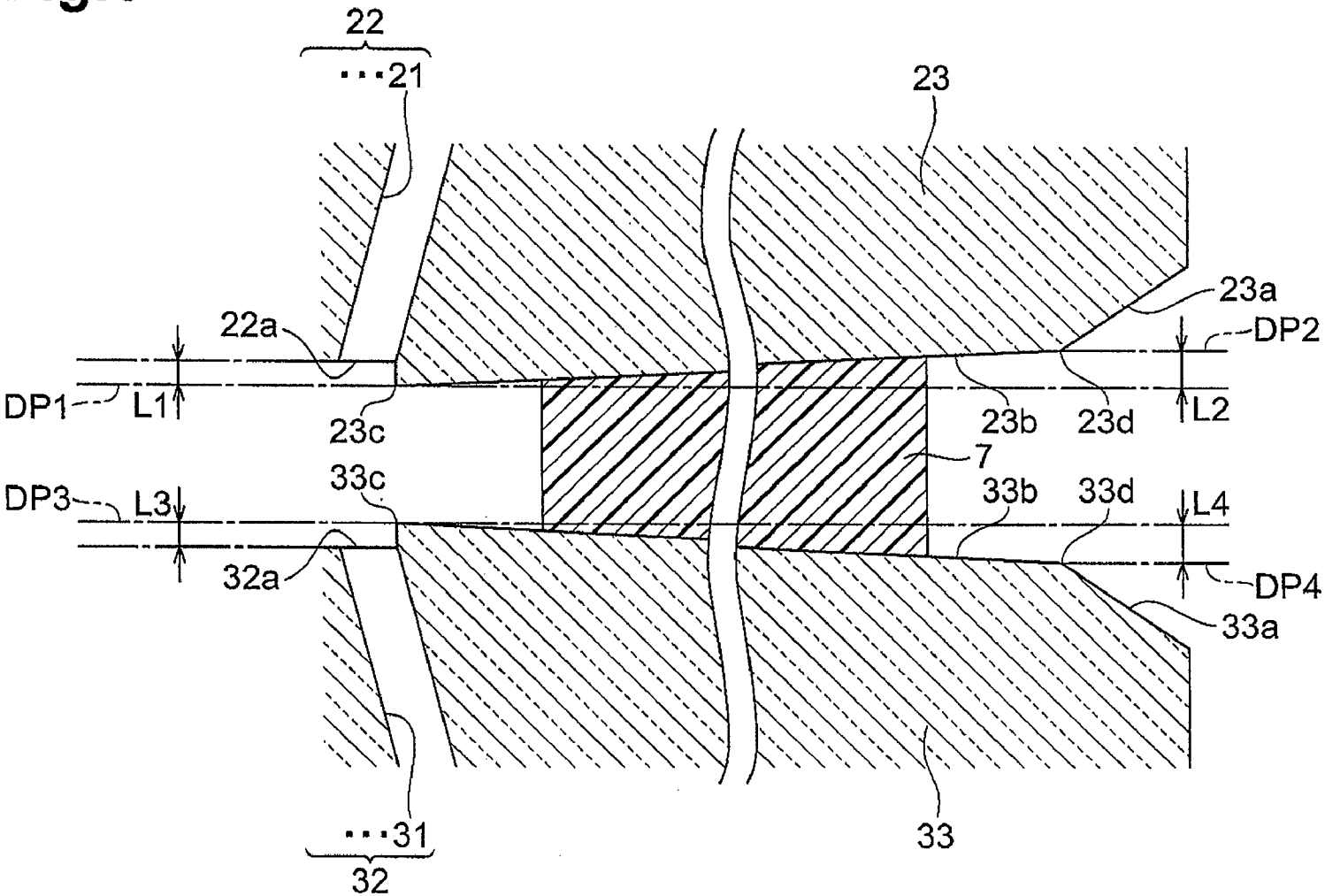
FIG. 5 is an enlarged view of a part surrounded by B in FIG. 4.

FIG. 5 is an enlarged view of a part surrounded by B in FIG. 4. As shown in FIG. 5, the channel portion 22 of the MCP 2 is formed thinner than the marginal portion 23, and therefore, the channel portion 22 is depressed in the thickness direction with respect to the bonding surface 23*b* of the marginal portion 23. Concretely, with respect to a reference plane of the bonding surface 23*b*, that is, a first reference plane (shown by an alternate long and short dash line DP1 in FIG. 5) vertical to the central axis of the MCP 2 and passing through an inner marginal portion of the bonding surface 23*b*, an emission surface 22*a* of the channel portion 22 is depressed by L1 in the thickness direction of the MCP 2. The amount of depression L1 is provided as, for example, 1 μm to 5 μm. Thus, as a result of depression of the channel portion 22 in the thickness direction, an approximately right-angled corner portion 23*c* is formed, in the marginal portion 23, on the inner marginal side of the bonding surface 23*b*. Although not illustrated in FIG. 5, the channel portion 22 of the MCP 2 is depressed in the thickness direction with respect to the marginal portion 23, also on the electron incident surface 2*a* side, by being formed thinner than the marginal portion 23, whereby a corner portion is formed at an inner rim side of the marginal portion 23.

The marginal portion 23 of the MCP 2 has the sloping bonding surface 23*b* so as to become thinner from the inner peripheral side toward the outer peripheral side, and therefore, a separation distance between the bonding surface 23*b* and the bonding surface 33*b* of the MCP 3 increases from the inner peripheral side toward the outer peripheral side. Concretely, the bonding surface 23*b* of the marginal portion 23 gently slopes so that the distance from the bonding surface 33*b* of the MCP 3 gradually increases from the inner peripheral side toward the outer peripheral side, and the slope displacement L2 between a second reference plane (shown by an alternate long and short dash line DP2 in FIG. 5) vertical to the central axis of the MCP 2 and passing through a corner portion 23*d* of the chamfered portion 23*a* closer to the bonding surface 23*b* and the first reference plane DP1 is provided as, for example, 2 μm to 3 μm. Although not illustrated in FIG. 5, the marginal portion 23 of the MCP 2, also on the electron incident surface 2*a* side, has a sloping surface so as to become thinner from the inner peripheral side toward the outer peripheral side.

The MCP 3 has the same configuration as that of the MCP 2. More specifically, the channel portion 32 of the MCP 3 is formed thinner than the marginal portion 33, and therefore, the channel portion 32 is depressed in the thickness direction with respect to the bonding surface 33*b* of the marginal portion 33. Concretely, with respect to a reference plane of the bonding surface 33*b*, that is, a first reference plane (shown by an alternate long and short dash line DP3 in FIG. 5) vertical to the central axis of the MCP 3 and passing through an inner marginal portion of the bonding surface 33*b*, an incident surface 32*a* of the channel portion 32 is depressed by L3 in the thickness direction of the MCP 3. The amount of depression L3 is provided as, for example, 1 μm to 5 μm. Thus, as a result of depression of the channel portion 32 in the thickness direction, an approximately right-angled corner portion 33*c* is formed on the inner marginal side of the bonding surface 33*b*. Although not illustrated in FIG. 5, the channel portion 32 of the MCP 3 is depressed in the thickness direction with respect to the marginal portion 33, also on the electron emission surface 3*a* side, by being formed thinner than the marginal portion 33, whereby a corner portion is formed at an inner rim side of the marginal portion 33.

The marginal portion 33 of the MCP 3 has the sloping bonding surface 33*b* so as to become thinner from the inner peripheral side toward the outer peripheral side, and therefore, a separation distance between the bonding surface 33*b* and the bonding surface 23*b* of the MCP 2 increases from the inner peripheral side toward the outer peripheral side. Concretely, the bonding surface 33*b* of the marginal portion 33 gently slopes so that the distance from the marginal portion 23 of the MCP 2 gradually increases from the inner peripheral side toward the outer peripheral side, and the slope displacement L4 between a second reference plane (shown by an alternate long and short dash line DP4 in FIG. 5) vertical to the central axis of the MCP 3 and passing through a corner portion 33*d* of the chamfered portion 33*a* closer to the bonding surface 33*b* and the first reference plane DP3 is provided as, for example, 2 μm to 3 μm. Although not illustrated in FIG. 5, the marginal portion 33 of the MCP 3, also on the electron emission surface 3*a* side, has a sloping surface so as to become thinner from the inner peripheral side toward the outer peripheral side.

The slope of the bonding surfaces 23*b*, 33*b* of the marginal portions 23, 33 of the MCPs 2, 3 is formed by selecting a pad of a flat polishing machine for a polishing process and polishing the surface so as to smoothly slope toward the outer periphery. Alternatively, the shape of the chamfered portions 23*a*, 33*a* may be changed to form chamfered portions directly as the bonding surfaces 23*b*, 33*b* by a chamfering tool.

Figure 6:
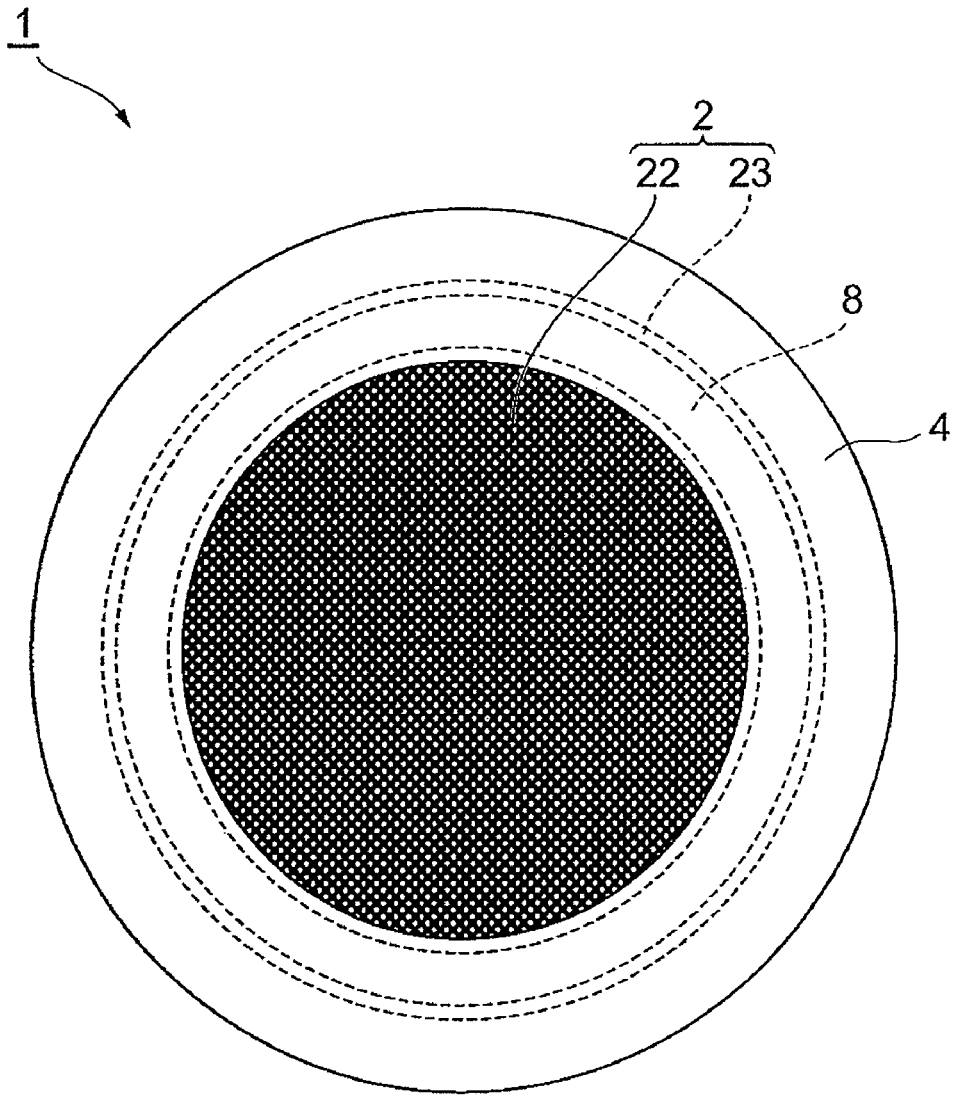
FIG. 6 is a plan view of the electron multiplier shown in FIG. 1.

FIG. 6 is a plan view of the electron multiplier 1 shown in FIG. 1. As shown in FIG. 6, the conductive adhesive 8 that bonds the input-side electrode plate 4 and the marginal portion 23 of the MCP 2 is arranged in an annular form so as to surround all around the channel portion 22 of the MCP 2. Although not illustrated, the conductive adhesive 9 that bonds the output-side electrode plate 6 and the marginal portion 33 of the MCP 3 is also arranged in an annular form so as to surround all around the channel portion 32 of the MCP 3. As this conductive adhesive 8, 9, the same conductive adhesive as that for the spacer layer 7 can be used.

Figure 7:
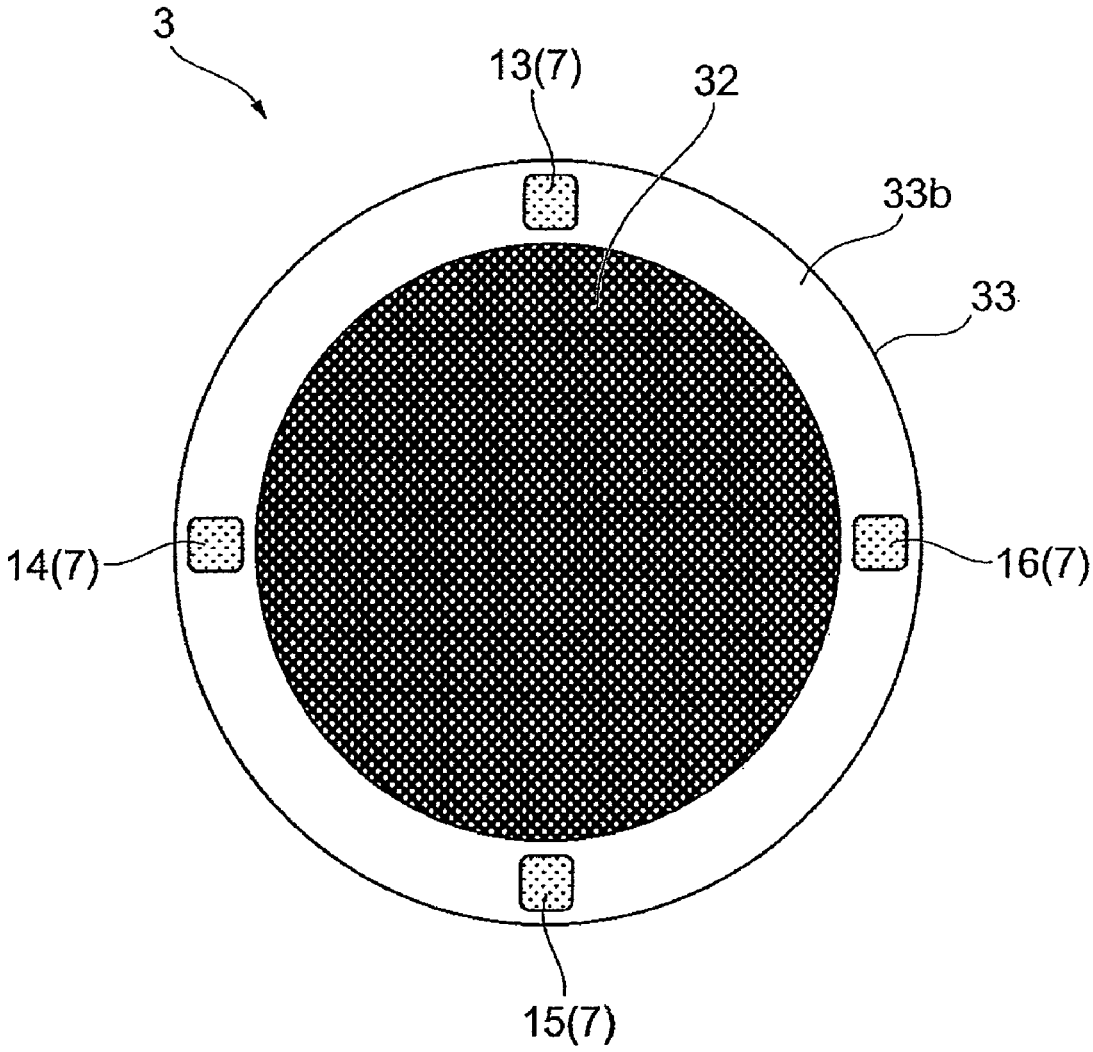
FIG. 7 is a plan view showing a bonding surface of an MCP.

FIG. 7 is a plan view showing the bonding surface 33*b* of the MCP 3 with the MCP 2. In FIG. 7, illustration of the MCP 2, the input-side electrode plate 4, and the output-side electrode plate 6 is omitted. The spacer layer 7 to be formed between the MCP 2 and the MCP 3 is composed of four adhesion pieces 13, 14, 15, and 16 arranged on the bonding surface 33*b* of the marginal portion 33 of the MCP 3. The adhesion pieces 13, 14, 15, and 16 are formed by arranging on the bonding surface 33*b* a conductive adhesive cut out in 2 mm square pieces at intervals of 90° around the central axis of the MCP 3. The adhesion pieces 13, 14, 15, and 16 are separated from each other. By providing such a configuration, conductance of the gap 12 between the channel portion 22 of the MCP 2 and the channel portion 32 of the MCP 3 with surrounding spaces declines, which allows improving the degree of vacuum in the gap 12.

For the adhesion pieces 13, 14, 15, and 16, a thermoplastic adhesive with conductivity is used. This thermoplastic adhesive exhibits plasticity at approximately 150° C. In the present embodiment, by selecting the thickness of the adhesion pieces 13, 14, 15, and 16 of the spacer layer 7 in a range of 30 μm to 500 μm, the size of the gap 12 between the MCPs 2 and 3 can be adjusted. The size and the application amount of the adhesion pieces 13, 14, 15, and 16 can be easily controlled by a dispenser.

The spacer layer 7 thus configured is formed by arranging the adhesion pieces 13, 14, 15, and 16 molded in advance in 2 mm square pieces on the bonding surface 33*b* of the MCP 3, laminating thereon the MCP 2, and pressurizing while heating at 150° C. A weight is used for the pressurization, and for the MCPs 2, 3 of, for example, 32 mm, a weight of approximately 200 g is suitable. In order to prevent the MCPs 2, 3 from oxidizing and changing in characteristics, the heating is preferably conducted under nitrogen ambient or in a vacuum. Moreover, before adhesion, the angle and orientation of the MCPs 2, 3 are regulated.

Next, the operation and effects of the electron multiplier 1 according to the present embodiment will be described.

Figure 8:
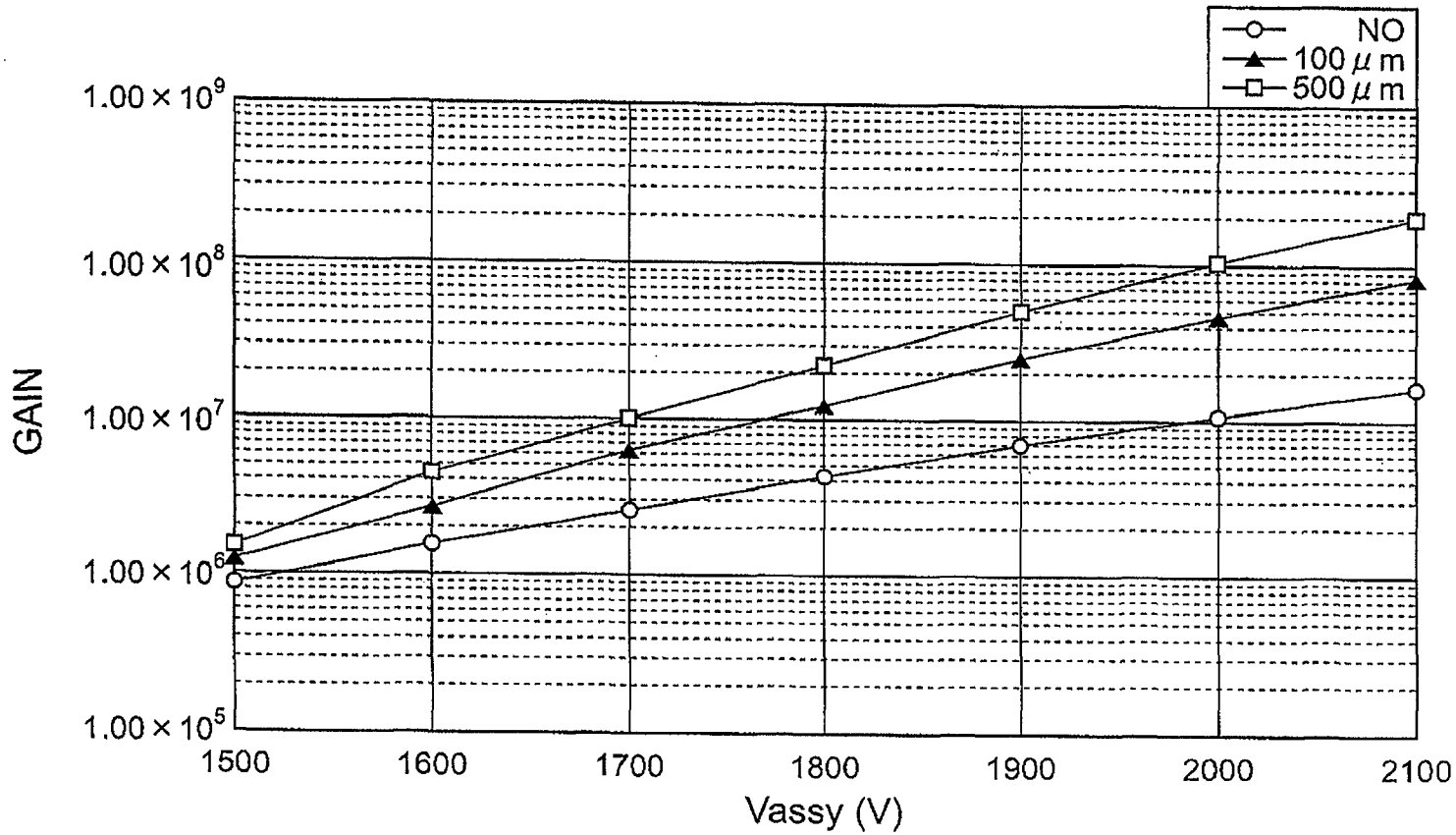
FIG. 8 is a diagram showing a relationship between the voltage and gain when the size of a gap between MCPs is changed.
Figure 9:
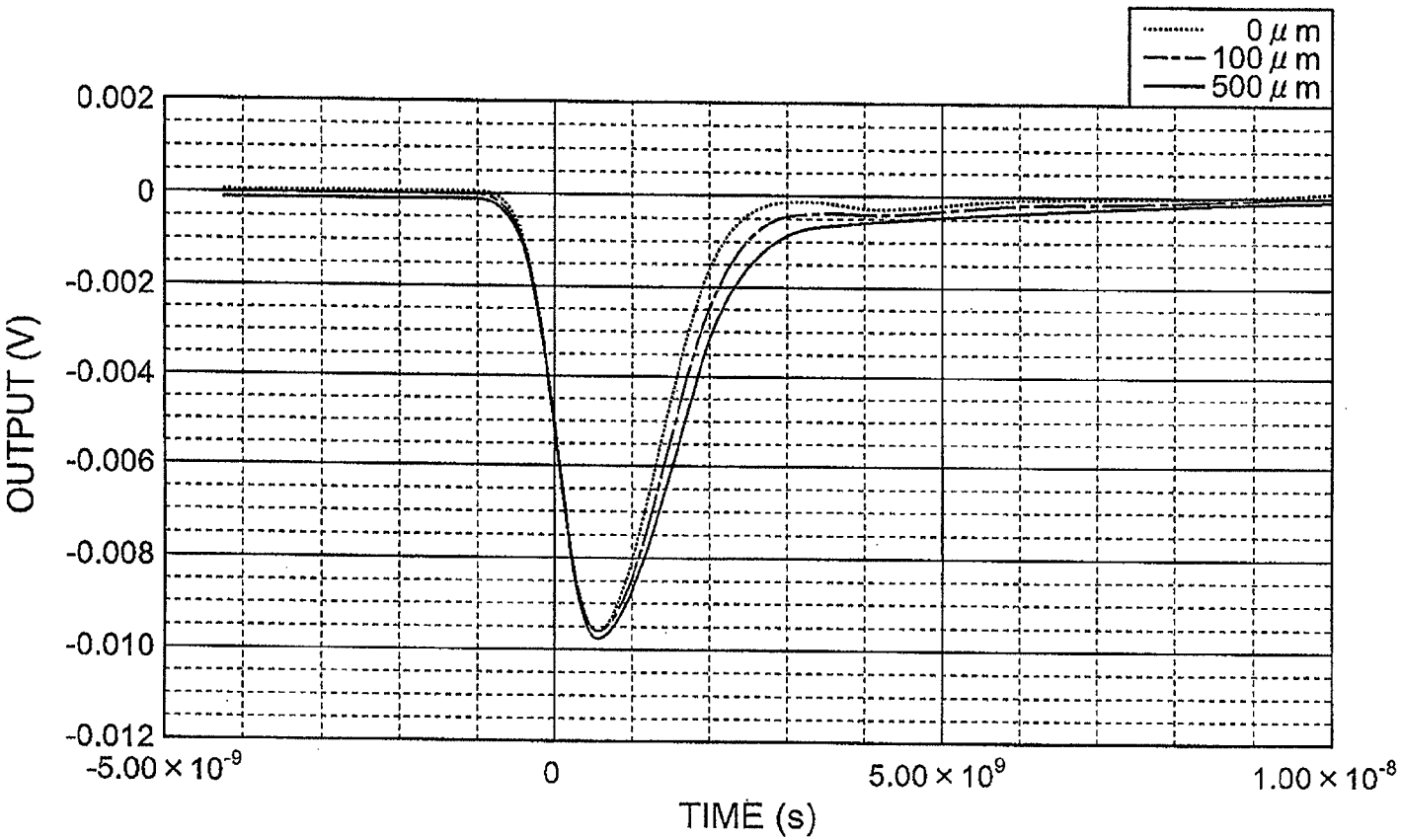
FIG. 9 is a diagram showing a relationship between the time and output when the size of a gap between MCPs is changed.

FIG. 8 is a diagram showing a relationship between the voltage and gain when the size of the gap 12 between the MCPs 2, 3 is changed. FIG. 9 is a diagram showing a relationship between the time and output when the size of the gap 12 between the MCPs 2, 3 is changed. In examples of FIG. 8 and FIG. 9, results of a measurement performed in terms of an electron multiplier with no gap 12 (0 μm), an electron multiplier with the gap 12 of 100 μm, and an electron multiplier with the gap 12 of 500 μm are shown. In these electron multipliers, the spacer layer 7 is made of a thermoplastic adhesive, and the effective diameter of the MCPs 2, 3 is set to 42 mm, the channel diameter, to 12 μm, the normalized length α obtained by dividing the channel length by the channel diameter, to 40, the bias angle, to 12°, and the ratio OAR of a total opening area of all channels 21, 31 to the whole area of the channel portion 22, 32, to 60%. At this time, the voltage of the MCPs 2, 3 is adjusted so that peak voltages of output signals are equalized while the measurement is performed.

When the gap 12 between the MCP 2 and the MCP 3 is large, because multiplied electrons that are emitted from the MCP 2 spread wide in the gap 12 to be made incident into the MCP 3, the multiplied electrons enter many channels 31 of the MCP 3, and the gain of the electron multiplier increases. As shown in FIG. 8, the gain has increased more in the electron multiplier with the gap 12 of 100 μm than in the electron multiplier with no gap 12 (0 μm) in terms of all voltages of 1500V to 2100V. Further, the gain has increased more in the electron multiplier with the gap 12 of 500 μm than in the electron multiplier with the gap 12 of 100 μm. On the other hand, when the gap 12 is large, multiplied electrons vary in traveling distance from each other because multiplied electrons that are emitted from the MCP 2 to be made incident into the MCP 3 spread wide in the gap 12, so that time characteristics deteriorate. As shown in FIG. 9, the falling time is smaller in the electron multiplier with the gap 12 of 100 μm than in the electron multiplier with the gap 12 of 500 μm, and the time characteristics have been improved. Further, the falling time is smaller in the electron multiplier with no gap 12 (0 μm) than in the electron multiplier with the gap 12 of 100 μm, and the time characteristics have been improved. Thus, between the gain and time characteristics of the electron multiplier 1, a trade-off relationship holds that the gain increases when the gap 12 between the MCP 2 and the MCP 3 is increased, and the time characteristics are improved when the gap 12 is reduced.

As in the above, in the electron multiplier 1 according to the present embodiment, when this is used for a purpose that requires a particularly high gain, by adjusting the thickness of the spacer layer 7, the gain can be increased by increasing the gap 12 between the MCP 2 and the MCP 3. In addition, when this is used for a purpose that requires an increase in gain as well as time characteristics, by adjusting the thickness of the spacer layer 7, desired characteristics can be obtained by adjusting the size of the gap 12. Consequently, by only adjusting the thickness of the spacer layer 7, characteristics according to the purpose can be easily obtained.

Further, in the electron multiplier 1, because the annular input-side electrode plate 4 and output-side electrode plate 6 to be bonded to the marginal portions 23, 33 are provided on the electron incident surface 2*a* side and the electron emission surface 3*a* side of the laminated MCPs 2, 3, it becomes easier to carry the electron multiplier 1 as an electronic component where MCPs and electron plates are laminated and integrated, and incorporation into another electronic device can be made easier.

Moreover, because the channel portions 22, 32 and the marginal portions 23, 33 of the MCPs 2, 3 are different in the degree of shrinkage at the time of restoration, restoration can possibly increase deflection of the MCPs 2, 3. For example, in time-of-flight mass spectrometry, a difference occurs in the time of arrival of ions due to this deflection, and the time difference becomes 2 ns to be critically large in the case of a deflection amount of 100 μm, an ion mass of 1000 u, and an ion accelerating voltage of 10 kV. However, in the electron multiplier 1 according to the present embodiment, because the marginal portions 23, 33 of the MCPs 2, 3 are sandwiched with the annular input-side electrode plate 4 and output-side electrode plate 6, the deflection of the MCPs 2, 3 can be corrected. Further, because the input-side electrode plate 4 and the output-side electrode plate 6 have larger outer peripheries than the marginal portions 23, 33 of the MCPs 2, 3, the deflection of the MCPs 2, 3 can be more reliably corrected.

Moreover, in the electron multiplier 1 according to the present embodiment, the bonding surfaces 23*b*, 33*b* of the marginal portions 23, 33 are separated from each other via the spacer layer 7, and the separation distance therebetween increases from the inner peripheral side toward the outer peripheral side. When the MCPs 2, 3 contact each other or when an adhesive flows in the channel portions 22, 32 of the MCPs 2, 3, large noise is generated by electrical discharge. However, in the present embodiment, because the bonding surface 23*b* and the bonding surface 33*b* on which the thermoplastic adhesive to form the spacer layer 7 is arranged are separated, and the separation distance therebetween increases from the inner peripheral side toward the outer peripheral side, it becomes possible to make the thermoplastic adhesive of the spacer layer 7 easily spread to the outer peripheral side, which allows suppressing the thermoplastic adhesive from flowing out toward the channel portions 22, 23, that are on the inner peripheral side.

Moreover, in the electron multiplier 1 according to the present embodiment, the marginal portions 23, 33 have, on the inner marginal side of the bonding surfaces 23*b*, 33*b* on which the spacer layer 7 is arranged, the corner portions 23*c*, 33*c* that are formed by the channel portions 22, 32 being respectively depressed in the thickness direction. Mutual contact of the channel portions 22, 32 is prevented by depression of the channel portions 22, 32, and by blocking, at the corner portions 23*c*, 33*c* formed on the inner marginal side of the bonding surfaces 23*b*, 33*b*, the thermoplastic adhesive spreading to the inner peripheral side, the thermoplastic adhesive can be prevented from flowing out to contact with the top of the emission surface 22*a* of the channel portion 22 or the incident surface 32*a* of the channel portion 32.

Moreover, in the electron multiplier 1 according to the present embodiment, because the spacer layer 7 is composed of the adhesion pieces 13, 14, 15, and 16 made of a thermoplastic adhesive, as compared with when forming the gap 12 between the MCPs 2, 3 by use of a spacer ring, the size of the gap 12 can be adjusted flexibly. Moreover, in the case of bonding the MCPs 2, 3 to each other by metal deposition, it is difficult to form a large gap 12 of a few hundred micrometers, however, a large gap 12 can be easily formed by using a thermoplastic adhesive for the spacer layer 7.

Moreover, in the case of bonding the MCPs 2, 3 to each other by metal deposition, the MCPs 2, 3 are oxidized by being heated at high temperature, and the resistance value of the MCPs 2, 3 rises. Because the amount of current to be supplied to the MCP 2 falls when the resistance value of the MCPs 2, 3 increases, decline in dynamic range occurs. For example, although the melting point of indium, which is a poorly oxidizing and malleable metal with a low melting point, is 156.4° C., because a higher temperature is required for performing vapor deposition, the resistance value of the MCPs 2, 3 rises. On the other hand, because the heating temperature is 150° C., which is low, when a thermoplastic adhesive is used for the spacer layer 7, a rise in the resistance value of the MCPs 2, 3 can be suppressed compared to when metal deposition is performed, and the dynamic range can be maintained.

Moreover, because the thermoplastic adhesive to be used for the adhesion pieces 13, 14, 15, and 16 has a considerable viscosity even at a temperature to exhibit plasticity, a large variation in the size of the gap 12 can be prevented in the process of adhesion. Moreover, because of the high viscosity, the adhesive can be prevented from flowing out to the channel portions 22, 32 of the MCPs 2, 3.

The present invention is by no means limited to the above-described embodiment.

For example, in the present embodiment, although a thermoplastic adhesive is used for the adhesion pieces 13, 14, 15, and 16 of the spacer layer 7, a thermosetting adhesive with conductivity may be used instead. The thermosetting adhesive, because of a lower viscosity than that of the thermoplastic adhesive, is suitable for reducing the thickness of the spacer layer 7 to reduce the size of the gap 12. Although the thermosetting adhesive is low in viscosity, by the slope structure of the bonding surfaces of the marginal portions 23, 33 and the depression structure of the channel portions 22, 32 of the MCPs 2, 3 in the electron multiplier 1 according to the present embodiment, the thermosetting adhesive can be prevented from flowing out to the channel portions 22, 32. Examples of such a thermosetting adhesive that can be used include DM6030Hk. In addition, the gap 12 can be reduced also by forming the spacer layer 7 of a metal, such as a solder and In, that melts at low temperature, in place of the thermosetting adhesive.

Figure 10:
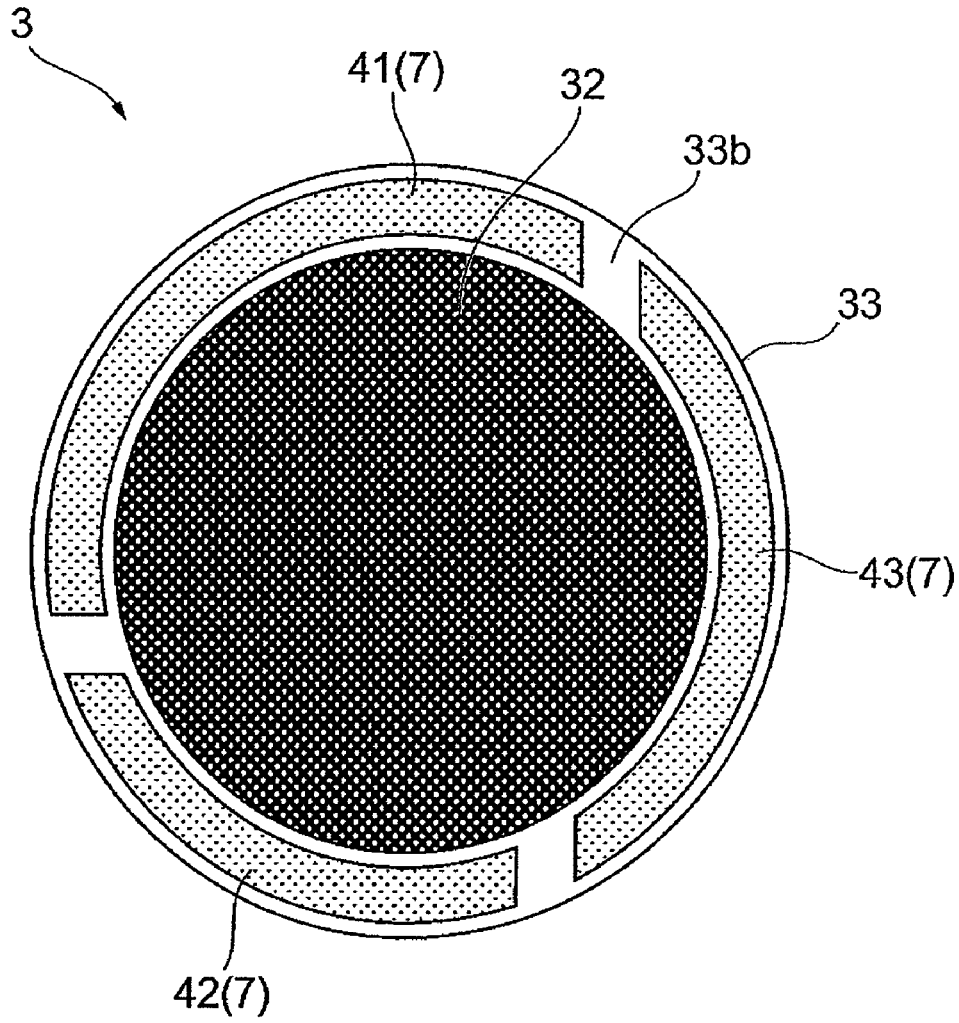
FIG. 10 is a plan view showing a bonding surface of an MCP of an electron multiplier according to a modification, corresponding to FIG. 7.
Figure 11:
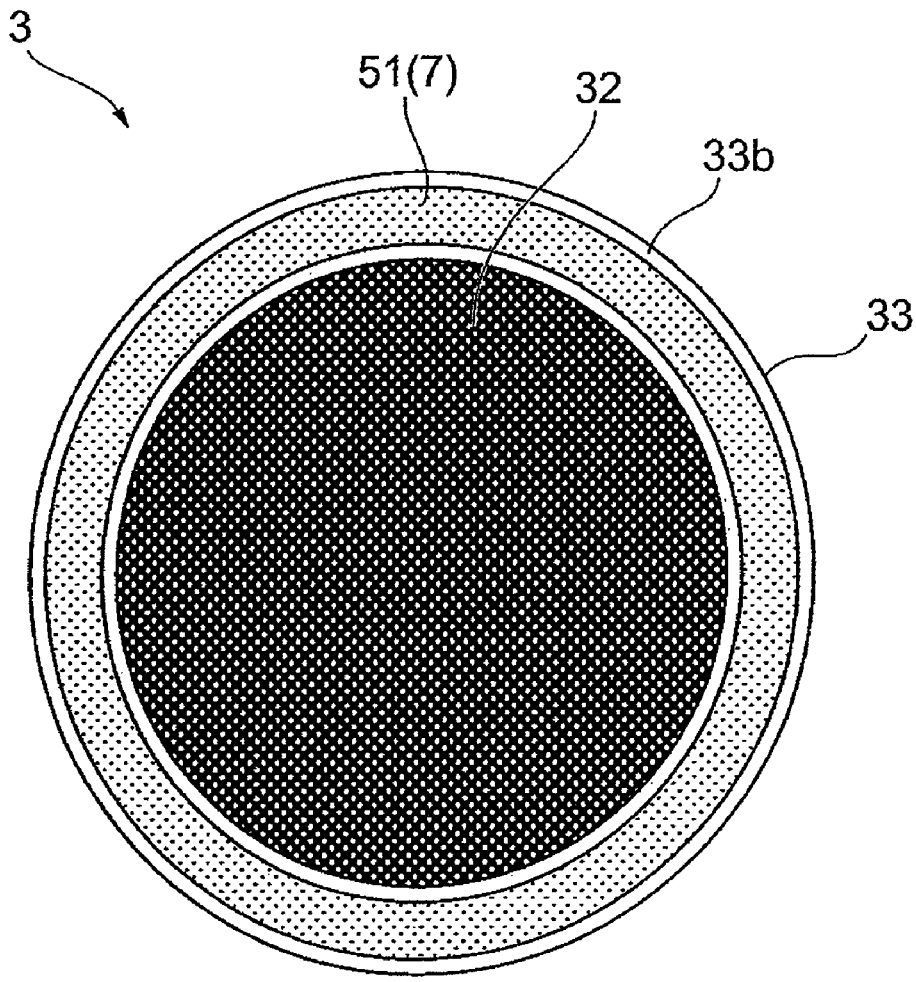
FIG. 11 is a plan view showing a bonding surface of an MCP of an electron multiplier according to a modification, corresponding to FIG. 7.

Moreover, in the present embodiment, as shown in FIG. 7, although the spacer layer 7 is composed of the adhesion pieces 13, 14, 15, and 16 cut out in square pieces, the spacer layer 7 may instead be composed of, as shown in FIG. 10, arc-shaped adhesion pieces 41, 42, and 43. The adhesion pieces 41, 42, and 43 are formed by cutting and dividing an annular adhesive piece at three points. Moreover, as shown in FIG. 11, the spacer layer 7 may be composed of only an annular adhesion piece 51.

Figure 12:
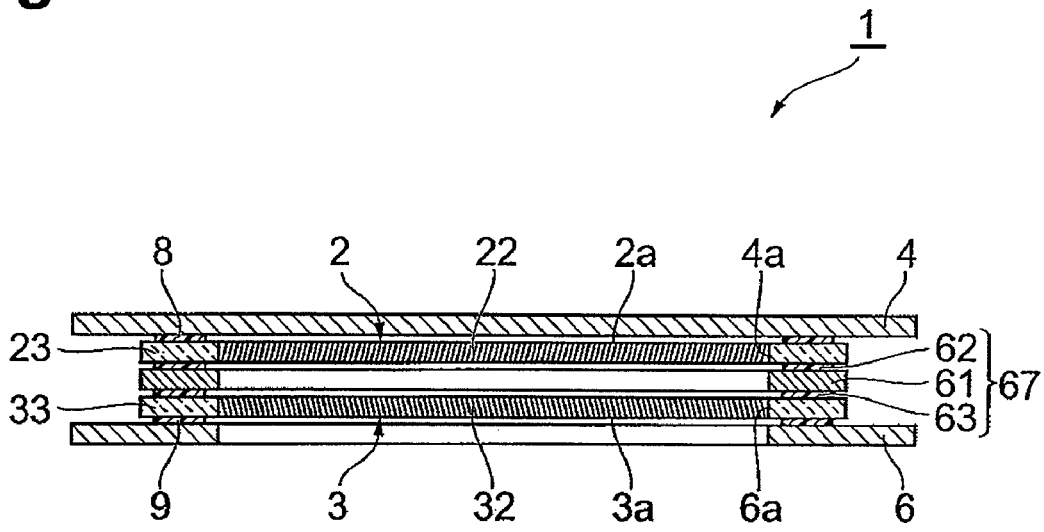
FIG. 12 is a sectional view of an electron multiplier according to a modification, corresponding to FIG. 3.

Moreover, in the present embodiment, although the spacer layer 7 is composed of only the adhesive, the spacer layer may instead include, as shown in FIG. 12, a metallic ring-shaped spacer member 61. A spacer layer 67 is formed by arranging, in a space between the MCP 2 and the MCP 3, the metallic ring-shaped spacer member 61 being in substantially the same shape as the marginal portions 23, 33, and arranging on both surfaces of the spacer member 61 adhesion pieces 62, 63 made of a conductive thermoplastic adhesive or a conductive thermosetting adhesive to bond to the marginal portion 23 of the MCP 2 and the marginal portion 33 of the MCP 3. In the case of forming the gap 12 between the MCPs 2, 3 to 1 mm or more by only an adhesive, a large amount of adhesive is required. On the other hand, when the spacer member 61 is used, it becomes possible to form a relatively large gap 12 of approximately a few millimeters.

Moreover, in the present embodiment, the electron multiplier includes an input-side electrode plate and an output-side electrode, but may include only an input-side electrode plate. A usage example of an electron multiplier not including an output-side electrode plate will be described in the following.

Figure 13:
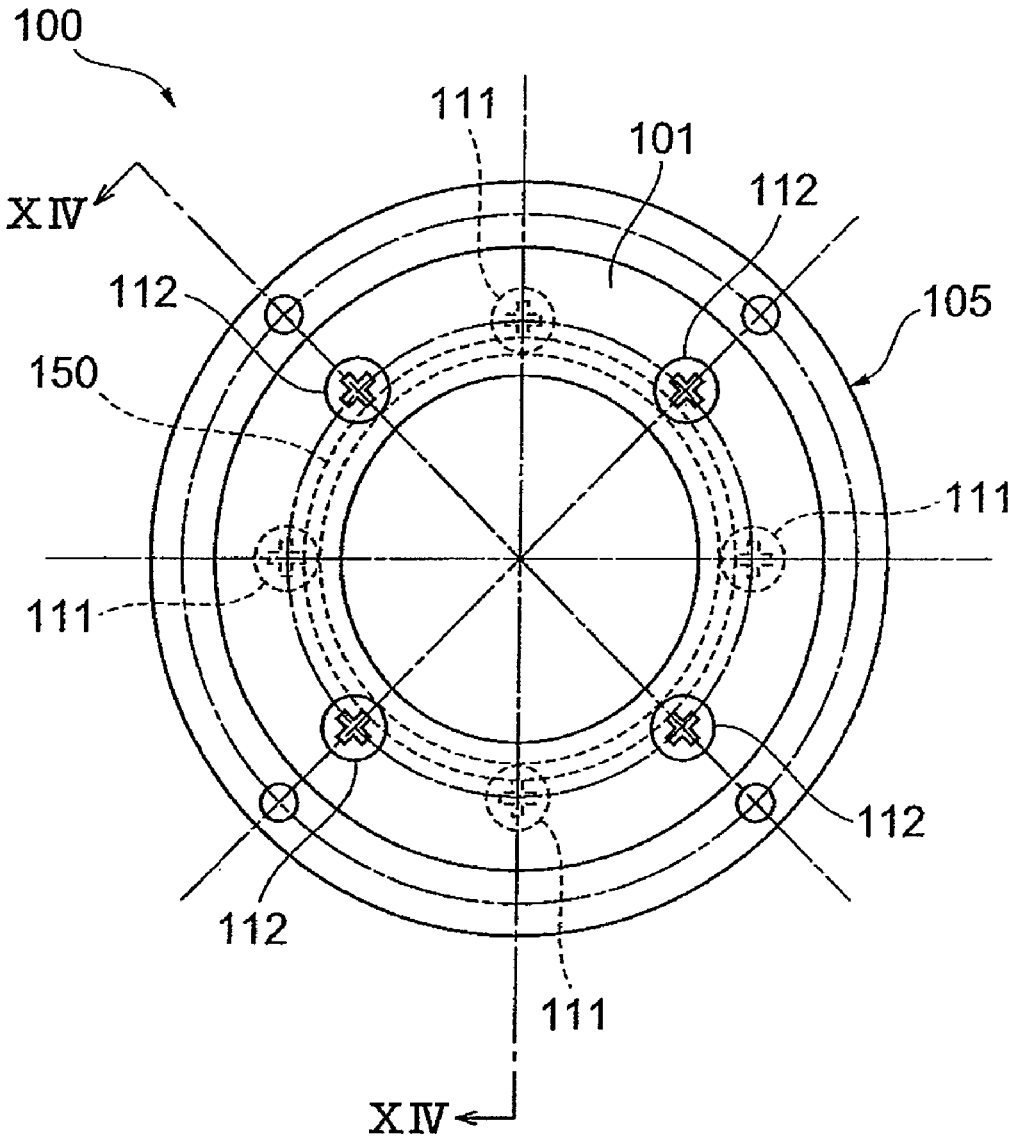
FIG. 13 is a front view of an electron detector according to an embodiment of the present invention, observed from an input side.
Figure 14:
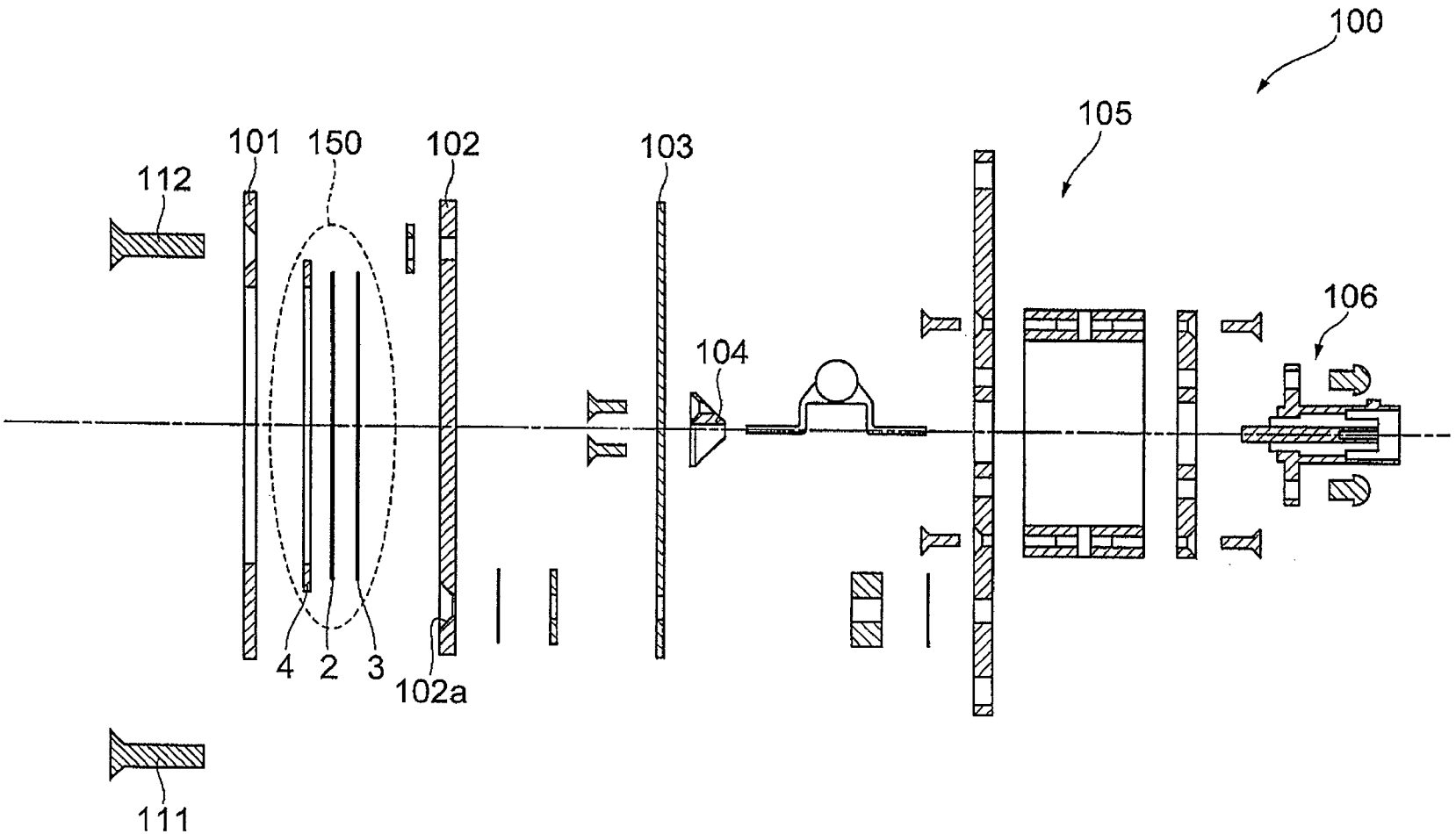
FIG. 14 is an exploded sectional view along a line XIV-XIV of FIG. 13.
Figure 15:
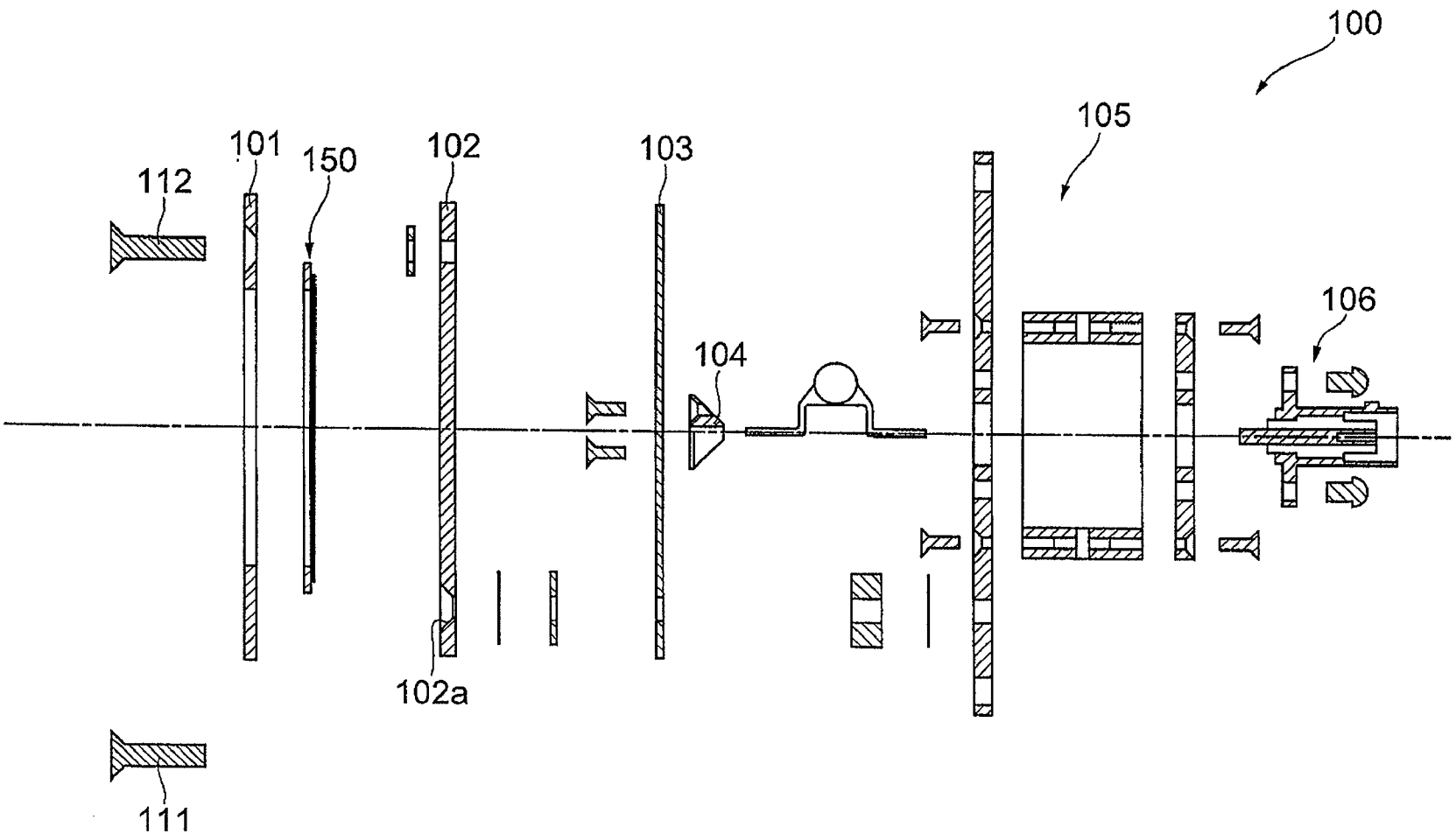
FIG. 15 is an exploded sectional view showing a state of incorporating an already-bonded electron multiplier into an electron detector.

FIG. 13 is a front view of an electron detector 100 according to an embodiment of the present invention, observed from an input side. FIG. 14 is an exploded sectional view along a line XIV-XIV of FIG. 13. Moreover, FIG. 15 is an exploded sectional view showing a state of incorporating an already-bonded electron multiplier 150 into an electron detector 100. This electron detector 100 is applied with an electron detector 150 not including an output-side electrode plate, and has a function of multiplying by this electron multiplier 150 and detecting the electrons. As shown in FIG. 13 and FIG. 14, the electron detector 100 includes an annular IN electrode 101 to serve as an input-side electrode of the electron detector 100, an OUT electrode 102 to serve as an output-side electrode of the electron detector 100, the electron multiplier 150 to be sandwiched between the IN electrode 101 and the OUT electrode 102, an anode substrate 103 to be arranged on a back surface side of the OUT electrode 102, an anode terminal 104 to be attached to a back surface of the anode substrate 103, a housing 105 that supports the electrodes and the substrate, and a BNC terminal 106 that is a signal output portion to be attached to a rear end side of the housing 105. In addition, Japanese Published Unexamined Patent Application No. 2007-87885 should be referred to for a detailed configuration of the electron detector 100. The electron multiplier 150 is composed of an input-side electrode plate 4 and MCPs 2, 3, and at the time of assembly of the electron detector 100, the electron multiplier 150 is attached as an assembly where the input-side electrode plate 4 and the MCPs 2, 3 have already been adhered to each other as shown in FIG. 15. At the time of attachment, the OUT electrode 102 is fixed to a flange of the housing 105 via the anode substrate 103 by screwing a housing screw 111 in a screw hole 102*a*. Then, by sandwiching the electron multiplier 150 with the IN electrode 101 and the OUT electrode 102 and fixing the IN electrode 101 and the OUT electrode 102 by an electron multiplier fixing screw 112, the electron multiplier 150 is attached.

Figure 16:
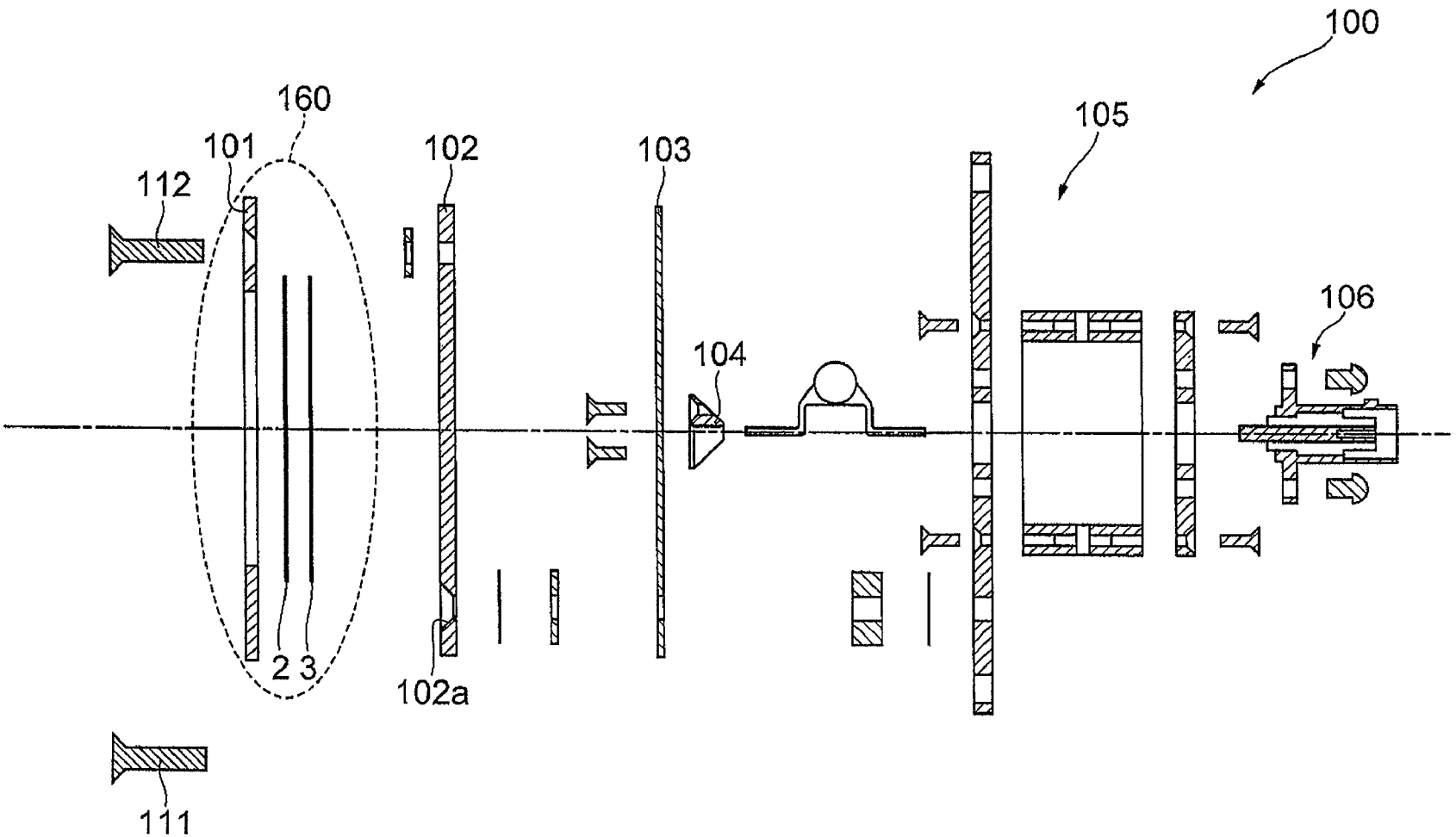
FIG. 16 is an exploded sectional view showing a modification of the electron detector shown in FIG. 14.
Figure 17:
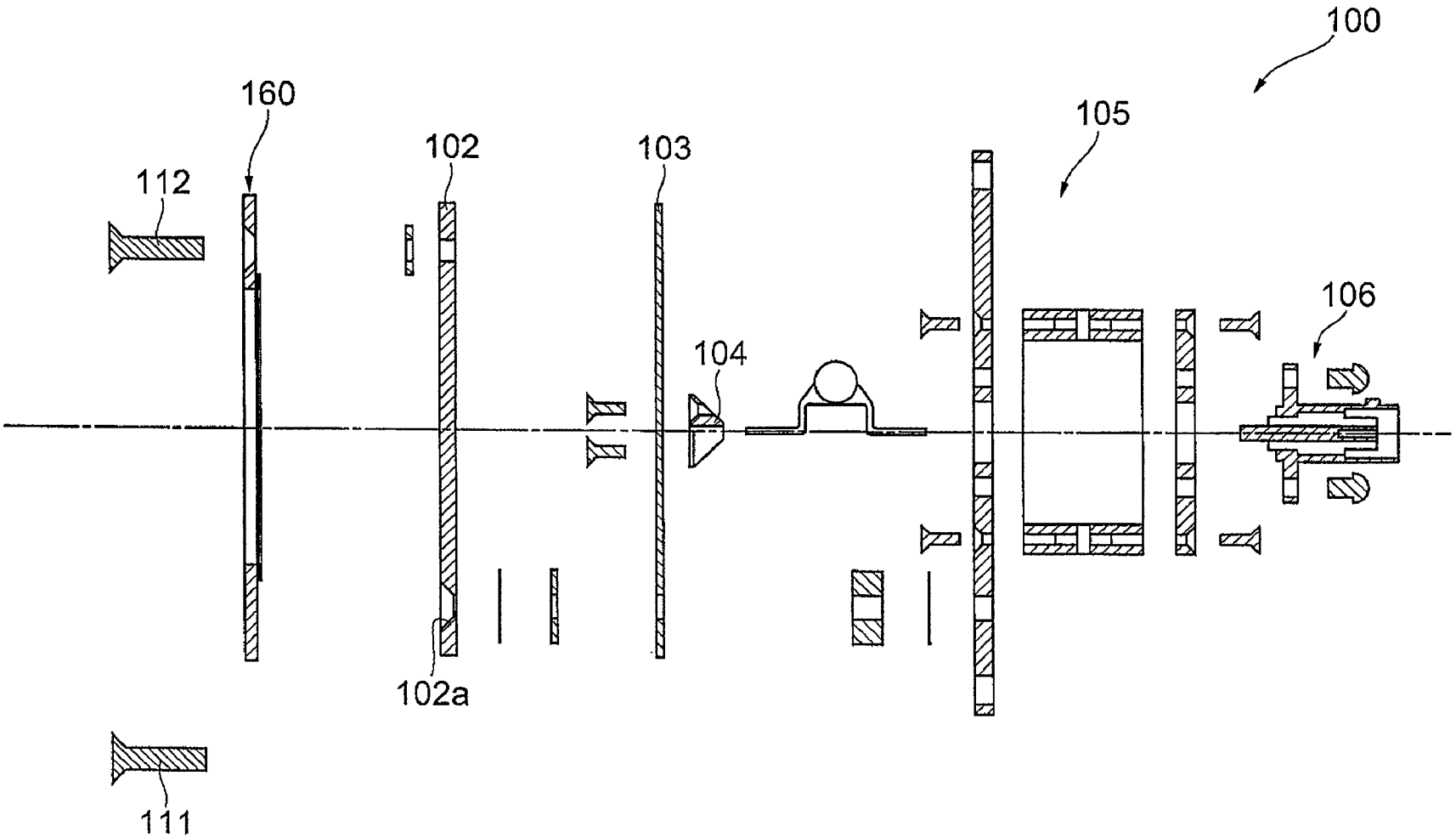
FIG. 17 is an exploded sectional view showing a state of incorporating an already-bonded electron multiplier into an electron detector.

Further, an electron multiplier to be incorporated in the electron detector 100 may be integrated with the IN electrode 101 of the electron detector 100. FIG. 16 is an exploded sectional view showing a modification of the electron detector 100 shown in FIG. 14. Moreover, FIG. 17 is an exploded sectional view showing a state of incorporating an already-bonded electron multiplier 160 into an electron detector 100. As shown in FIG. 16, the electron multiplier 160 is composed of the IN electrode 101 serving as an input-side electrode plate and MCPs 2, 3, and at the time of assembly of the electron detector 100, the electron multiplier 160 is attached as an assembly where the IN electrode 101 and the MCPs 2, 3 have already been adhered to each other as shown in FIG. 17. At the time of attachment, an OUT electrode 102 is fixed to a flange of a housing 105 via an anode substrate 103 by screwing a housing screw 111 in a screw hole 102*a*. Then, by arranging the electron multiplier 160 on an input side of the OUT-electrode 102 and fixing the IN electrode 101 of the electron multiplier 160 by an electron multiplier fixing screw 112 to the OUT electrode 102, the electron multiplier 160 is attached. Therefore, the electron multiplier 160 is connected directly to the electron detector 100 by the electron multiplier fixing screw 112.

Figure 18:
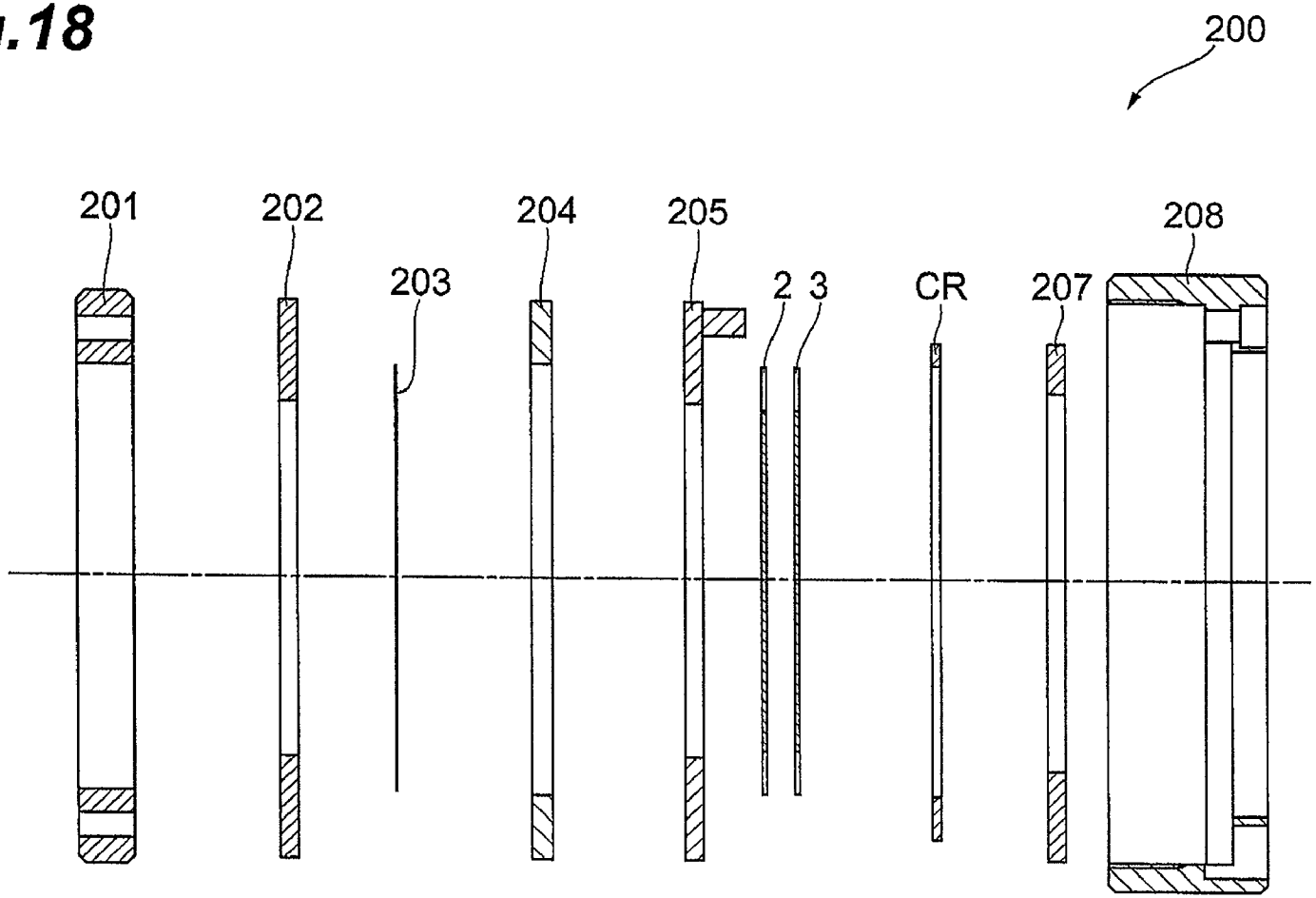
FIG. 18 is an exploded sectional view of a conventional cartridge.
Figure 19:
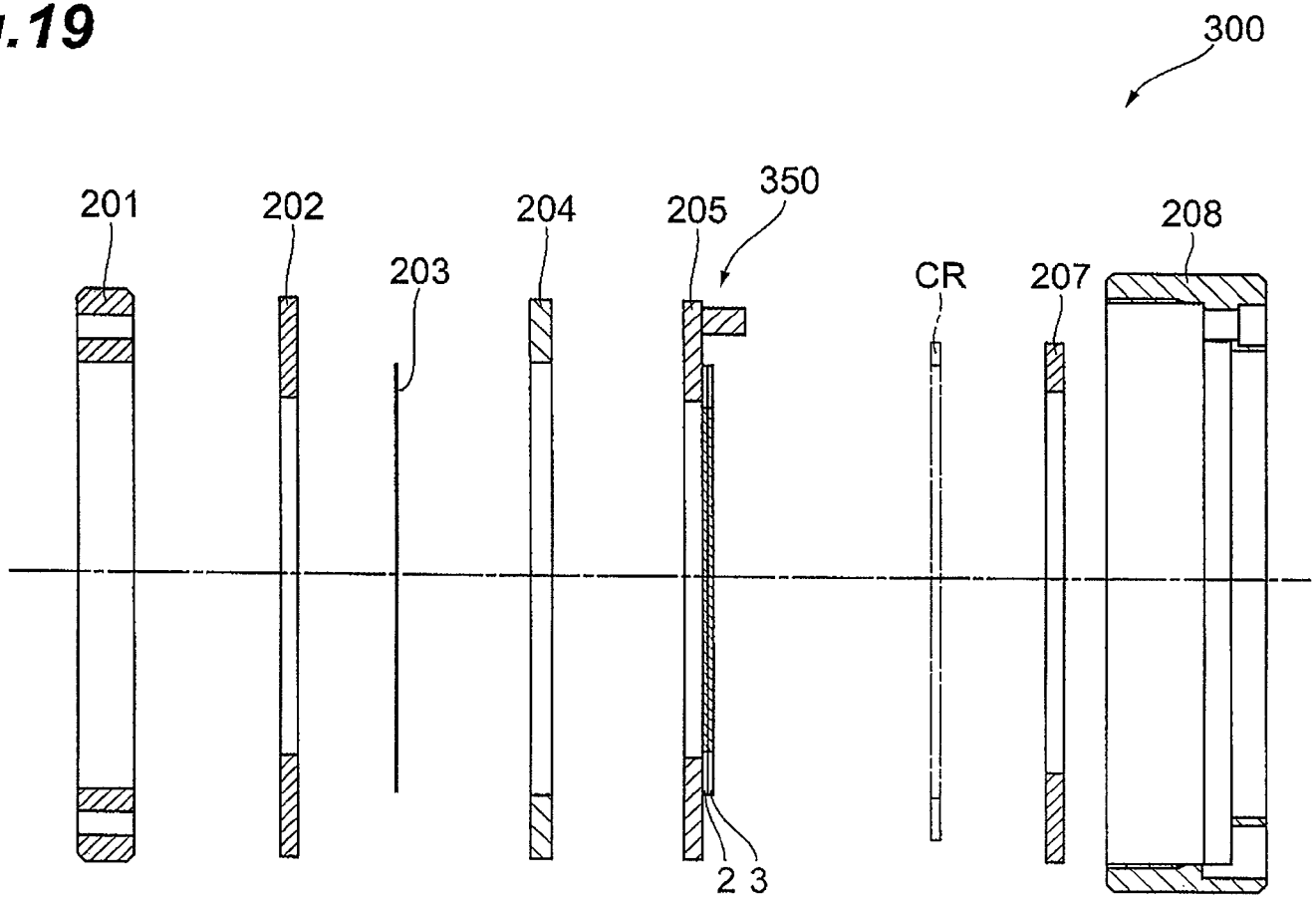
FIG. 19 is an exploded sectional view of a cartridge applied with an electron multiplier according to the embodiment of the present invention.

Further, an electron multiplier according to the present invention may be applied to a cartridge of the electron detector disclosed in U.S. Pat. No. 5,770,858. FIG. 18 is an exploded sectional view of a conventional cartridge, and FIG. 19 is an exploded sectional view of a cartridge applied with an electron multiplier according to the present invention. As shown in FIG. 18, the conventional cartridge 200 includes an annular ring retainer 201, a mesh electrode 202 to be arranged on a back surface of the ring retainer 201, a mesh 203 to be attached to the mesh electrode 202, an insulator 204, an IN electrode 205 for electron multiplication, a pair of MCPs 2, 3, a centering ring CR for performing alignment of the MCP 2, 3, an OUT electrode 207 for electron multiplication, and a holder 208 that stores the components. In addition, U.S. Pat. No. 5,770,858 should be referred to for a detailed configuration of the cartridge 200 and an electron detector incorporating this cartridge 200. In the conventional cartridge 200, by aligning the MCPs 2, 3 by the centering ring CR and sandwiching the MCPs 2, 3 with the IN electrode 205 and the OUT electrode 207, the MCPs 2, 3 are incorporated in the cartridge 200. On the other hand, in the cartridge 300 applied with the electron multiplier 350 according to the present invention, the electron multiplier 350 is formed as a single assembly by adhering the IN electrode 205 and the MCPs 2, 3 to each other. Accordingly, when assembling the cartridge 300, the cartridge 300 can be assembled by an operation of only incorporating the electron multiplier 350 serving as an assembly, without performing alignment of the MCPs 2, 3. Thus, because the MCPs 2, 3 are incorporated as an assembly by being adhered to the IN electrode 205, it becomes possible to eliminate the need for the centering ring CR at the time of assembly of the cartridge 300, and the number of components and operation processes can be reduced.

Although a description has been given, in the embodiment shown in FIG. 13 to FIG. 19, for an example of applying an electron multiplier not including an output-side electrode plate to an electron detector or a cartridge, an electron multiplier including an input-side electrode plate 4 and an output-side electrode plate 6 may be applied to an electron detector or a cartridge.

The electron multiplier may further include an output-side electrode plate that is arranged on an electron emission surface side of the laminated micro-channel plates, and the output-side electrode plate may be formed in an annular shape and bonded to a marginal portion of the micro-channel plate. Because the micro-channel plate can be sandwiched with the input-side electrode plate and the output-side electrode plate, deflection of the micro-channel plate can be corrected.

Moreover, in the electron multiplier, the input-side electrode plate and the output-side electrode plate may have a larger outer periphery than the marginal portion of the micro-channel plate. By sandwiching with the input-side electrode plate and the output-side electrode plate having a larger outer periphery than the marginal portion of the micro-channel plate, deflection of the micro-channel plate can be corrected.

Moreover, in the electron multiplier, bonding surfaces of the respective marginal portions to be bonded to each other via a spacer layer may be separated from each other via the spacer layer, and a separation distance may increase from an inner peripheral side toward an outer peripheral side. As a result of the bonding surfaces to be bonded via the spacer layer being separated from each other and the separation distance therebetween increasing from the inner peripheral side toward the outer peripheral side, it becomes possible, for example, when the spacer layer is formed of a conductive adhesive, to make the adhesive easily spread to the outer peripheral side, which allows suppressing the adhesive from flowing out to channel portions that are on the inner peripheral side.

Moreover, in the electron multiplier, as a result of depression of the channel portion being depressed at its gap side in the thickness direction, a corner portion may be formed, in the marginal portion, on the inner marginal side. Mutual contact of the channel portions is prevented by depression of the channel portions. Moreover, for example, when the spacer layer is formed of a conductive adhesive, by blocking, at the corner portions formed on the inner marginal side of the bonding surfaces, the adhesive spreading to the inner peripheral side, the adhesive can be prevented from flowing out to contact with the channel portion.

Moreover, in the electron multiplier, the spacer layer may contain a thermoplastic adhesive. When the spacer layer contains a thermoplastic adhesive, by adjusting the thickness of the thermoplastic adhesive, the size of the gap can be adjusted flexibly. Moreover, as compared with when bonding micro-channel plates to each other by metal deposition, the gap can be easily formed. Moreover, because of the high viscosity, the thermoplastic adhesive can be prevented from flowing out to the channel portions that are on the inner peripheral side.

Moreover, in the electron multiplier, the spacer layer may contain a thermosetting adhesive. The thermosetting adhesive, because of a lower viscosity than that of the thermoplastic adhesive, is suitable for reducing the thickness of the spacer layer to reduce the size of the gap.

Moreover, in the electron multiplier, the spacer layer may include a metallic spacer member. In the case of forming a large gap by only an adhesive, a large amount of adhesive is required. However, when the metallic spacer member is used, it becomes possible to easily form a relatively large gap of approximately a few millimeters.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electron multiplier comprising:

a plurality of laminated micro-channel plates; and an input-side electrode plate that is arranged on an electron incident surface side of the laminated micro-channel plates, wherein the micro-channel plate includes a channel portion in which a plurality of channels penetrating in a thickness direction are formed and a marginal portion surrounding the channel portion, and has a gap formed between the channel portions of the respective micro-channel plates as a result of the marginal portions of the respective micro-channel plates being bonded to each other via a conductive spacer layer, and the input-side electrode plate is formed in an annular shape, and bonded to the marginal portion of the micro-channel plate.

2. The electron multiplier according to claim 1, further comprising an output-side electrode plate that is arranged on an electron emission surface side of the laminated micro-channel plates, wherein the output-side electrode plate is formed in an annular shape, and bonded to the marginal portion of the micro-channel plate.

3. The electron multiplier according to claim 2, wherein the input-side electrode plate and the output-side electrode plate have a larger outer periphery than the marginal portion of the micro-channel plate.

4. The electron multiplier according to claim 1, wherein bonding surfaces of the respective marginal portions to be bonded to each other via the spacer layer are separated from each other via the spacer layer, and a separation distance increases from an inner peripheral side toward an outer peripheral side.

5. The electron multiplier according to claim 1, wherein as a result of the channel portion being depressed at its gap side in a thickness direction, a corner portion is formed, in the marginal portion, on an inner marginal side.

6. The electron multiplier according to claim 1, wherein the spacer layer contains a thermoplastic adhesive.

7. The electron multiplier according to claim 1, wherein the spacer layer contains a thermosetting adhesive.

8. The electron multiplier according to claim 1, wherein the spacer layer includes a metallic spacer member.

9. An electron detector comprising the electron multiplier according to claim 1, wherein the electron multiplier multiplies electrons in order to detect the electrons.

* * * * *